US008735043B2

(12) United States Patent
Liu

(10) Patent No.: US 8,735,043 B2
(45) Date of Patent: May 27, 2014

(54) TONER IMAGE STABILIZATION PROCESSES

(75) Inventor: Chu-heng Liu, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 1077 days.

(21) Appl. No.: 12/101,938

(22) Filed: Apr. 11, 2008

(65) Prior Publication Data

US 2009/0258306 A1 Oct. 15, 2009

(51) Int. Cl.
*G03G 13/06* (2006.01)

(52) U.S. Cl.
USPC ..... 430/126.1; 430/45.1

(58) Field of Classification Search
USPC ..... 430/45.1, 126.1; 399/341
See application file for complete search history.

(56) References Cited

U.S. PATENT DOCUMENTS

| | | | | |
|---|---|---|---|---|
| 5,234,783 | A | 8/1993 | Ng | |
| 5,612,777 | A * | 3/1997 | Malhotra | 399/226 |
| 7,236,734 | B2 | 6/2007 | Ng et al. | |
| 2006/0251450 | A1 * | 11/2006 | Murayama et al. | 399/299 |
| 2006/0275058 | A1 * | 12/2006 | Omata | 399/302 |

FOREIGN PATENT DOCUMENTS

EP 537789 A2 * 4/1993

* cited by examiner

*Primary Examiner* — Jonathan Jelsma
(74) *Attorney, Agent, or Firm* — Fay Sharpe LLP

(57) ABSTRACT

Image noise is reduced in halftone imaging processes by placing clear toner particles around the colored toner particles. The clear toner particles must be placed around the colored toner particles prior to transferring the developed image from an imaging member to a receiving member or substrate. The clear toner particles force the colored toner particles to remain in their deposited location during transfer. The result is an image with less mottle and graininess.

8 Claims, 9 Drawing Sheets
(2 of 9 Drawing Sheet(s) Filed in Color)

TONER IMAGE STABILIZATION PROCESSES

BACKGROUND

The present disclosure relates to processes for increasing the quality of printed images. It relates particularly to methods of increasing the resolution of halftone images and/or stabilizing such images during various transfer processes.

In the art of electrophotography, an imaging member or plate comprising a photoconductive insulating layer on a conductive layer is imaged by first uniformly electrostatically charging the surface of the photoconductive insulating layer. The plate is then exposed to a pattern of activating electromagnetic radiation, for example light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example from a developer composition, on the surface of the photoconductive insulating layer. The resulting visible toner image can be transferred to a suitable receiving substrate such as paper. This imaging process may be repeated many times with reusable photoimaging members. This process is repeated multiple times for color images, which generally use multiple inks or toners of different color (e.g., cyan, magenta, yellow, black (CMYK)) to build up a final color image.

Imaging members are usually multilayered photoreceptors that comprise a supporting substrate, an electrically conductive layer, an optional hole-blocking layer, an optional adhesive layer, a charge generating layer, a charge transport layer, and an optional protective or overcoat layer(s). For some multilayered flexible photoreceptor belts, an anti-curl layer is employed on the reverse side of the substrate support, opposite to the side carrying the electrically active layers, to achieve the desired photoreceptor flatness. They can be used in the form of photoreceptor drums or as flexible imaging member belts.

Halftoning is a known process of producing different scales of colors. Conceptually, halftones are produced by grouping arrays of pixels or dots together into a halftone cell. Within the cell, some or all of the pixels are printed. The scale depends on the number of pixels in the cell. For example, in an 8×8 cell using only black ink, a grey scale having 65 possible shades ranging from solid black (all pixels printed) to solid white (no pixels printed) is possible. With higher numbers of pixels in a cell, higher resolution is possible. When color images are used, scales can be produced for each ink color, and when combined, the total color palette available for printing can be very large. Halftoning is described in *The Image Processing Handbook*, second edition, 1995, by John C. Russ, ISBN 0-8493-2516-1, and *Real World Scanning and Halftones*, second edition, 1998, by David Blatner, Glenn Fleishman, and Stephen F. Roth, ISBN 0-201-69683-5. Both of these books are hereby incorporated by reference in their entirety.

However, one factor of the final image quality is whether the toner particles remain in the pixel in which they are deposited. The toner image developed on the surface of the photoconductive insulating layer can be disturbed during the transfer process onto paper. This is known to be one of the major contributors to increased image noise. For example, as toner particles spread out of their pixel, mottle and/or graininess increase. Mottle is a spotty or uneven appearance. Graininess is a sandpaper-like variation at higher spatial frequencies. Both result in a poorer image. In addition, the color palette of color images is influenced by the degree to which the pixels of each color are superimposed on each other. Again, as toner particles of a particular color spread out of their pixel, the final color seen by an observer will change.

It would be desirable to be able to print halftone images that have reduced image noise, i.e. increased image quality.

BRIEF DESCRIPTION

Disclosed herein, in various embodiments, are processes for printing halftone images that have improved image quality and/or reduced noise (reduced mottle and/or graininess). Also disclosed are apparatuses which may be used in practicing the processes of the present disclosure.

In embodiments a method of printing halftone images is disclosed which comprises: providing an imaging member; producing an electrostatic latent image for a first color on the imaging member, the electrostatic latent image for the first color defining a group of pixels; developing the electrostatic latent image for the first color by depositing colored toner particles of the first color into a first set of pixels on the electrostatic latent image to form a dot in each pixel, each dot having a core and an edge, to form a developed image; stabilizing the developed image by placing stabilizing toner particles of a stabilizing color on the developed image to form a stabilized image; and transferring the stabilized image to a receiving substrate.

The developing step and stabilizing step may be carried out consecutively.

In some embodiments, the stabilizing step is performed by locating the stabilizing toner particles around the edge of each dot. The stabilizing step may alternatively be performed by depositing the toner particles having the stabilizing color in the form of dots into a second set of pixels on the developed image, wherein the first set of pixels and second set of pixels do not overlap.

The group of pixels may be divided into only the first set of pixels and the second set of pixels, or into the first set of pixels, the second set of pixels, and a third set of pixels.

The stabilizing toner particles are clear or have a colorant concentration substantially lower than the colored toner particles of the first color. Alternatively, the stabilizing color is the same color as the color of the receiving substrate.

In other embodiments, a method of printing halftone images of at least three colors is disclosed which comprises: providing an imaging member; forming a fully developed image with toner particles of at least three different colors by placing toner particles of each color in the form of dots into a first set of pixels on the imaging member; stabilizing the fully developed image by placing stabilizing toner particles of a stabilizing color to form a stabilized image; and transferring the stabilized image to a receiving substrate.

The stabilizing step can be performed by locating the stabilizing toner particles around a non-overlapping edge of each dot in the first set of pixels. The stabilizing step can also be performed by depositing the stabilizing toner particles in the form of dots into a second set of pixels on the developed image, wherein the first set of pixels and the second set of pixels do not overlap.

In some embodiments, the stabilizing step is performed by: producing a stabilizing electrostatic latent image of the stabilizing color on the imaging member; and developing the stabilizing electrostatic latent image by depositing toner particles of the stabilizing color in the form of dots on the stabilizing electrostatic latent image into a second set of pixels, wherein the first set of pixels and the second set of pixels do not overlap.

In other embodiments, the forming step can be performed by steps comprising: producing a first electrostatic latent image for a first color on the imaging member; developing the first electrostatic latent image by depositing toner particles of the first color in the form of dots on the first electrostatic latent image into a primary set of first color pixels; producing a second electrostatic latent image for a second color on the imaging member; developing the second electrostatic latent image by depositing toner particles of the second color in the form of dots on the second electrostatic latent image into a primary set of second color pixels; producing a third electrostatic latent image for a third color on the imaging member; and developing the third electrostatic latent image by depositing toner particles of the third color in the form of dots on the third electrostatic latent image into a primary set of third color pixels.

In additional embodiments, the stabilizing step may be performed by: placing stabilizing toner particles on the imaging member into a secondary set of first color pixels of the first image to produce a first stabilized partial image; placing stabilizing toner particles on the imaging member into a secondary set of second color pixels of the second image to produce a second stabilized partial image; and placing stabilizing toner particles on the imaging member into a secondary set of pixels of third color pixels of the third image to produce a third stabilized partial image.

In further embodiments, the transferring step may be performed by: transferring the first stabilized partial image to the receiving substrate; transferring the second stabilized partial image to the receiving substrate; and transferring the third stabilized partial image to the receiving substrate. The first, second, and third stabilized partial images together make up the stabilized image.

In certain embodiments, the forming step and the stabilizing step are carried out consecutively.

These and other non-limiting characteristics are more particularly described below.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The following is a brief description of the drawings, which are presented for the purpose of illustrating the exemplary embodiments disclosed herein and not for the purpose of limiting the same.

DETAILED DESCRIPTION

Figure 1:
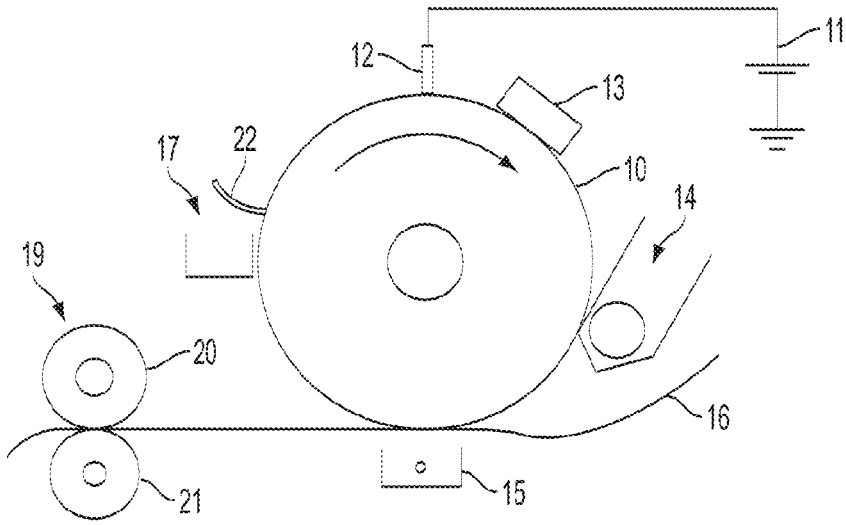
FIG. 1 is an illustration of a typical black and white printing process.

A more complete understanding of the components, processes, and apparatuses disclosed herein can be obtained by reference to the accompanying figures. These figures are merely schematic representations based on convenience and the ease of demonstrating the present development and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

FIG. 1 illustrates the xerographic process in a typical electrostatographic apparatus which can be used to print black and white images. A light image of an original to be copied is recorded in the form of an electrostatic latent image upon a photosensitive imaging member, the latent image is subsequently developed by the application of electroscopic toner particles, and the developed image is transferred to a substrate such as paper. As shown here, going clockwise, photoreceptor 10 receives a substantially uniform electrostatic charge on its surface via charging station 12 to which a voltage has been supplied from power supply 11. The photoreceptor is then imagewise exposed to light at imaging station 13 from an optical system or an image input apparatus, such as a laser or light emitting diode, to form an electrostatic latent image thereon by selectively altering the substantially uniform electrostatic charge. The electrostatic latent image is then developed at developing station 14 by contacting the electrostatic latent image with toner particles. Development can be effected by use of a magnetic brush, powder cloud, or other known development processes. The developed image is transferred to a receiving substrate 16, such as paper, at transfer station 15. Here, substrate 16 moves from right to left. If desired, the developed image can be transferred to an intermediate transfer member (not shown) and subsequently transferred to the receiving substrate. After the transfer of the developed image is completed, substrate 16 advances to fusing station 19, depicted here as fusing and pressure rolls, wherein the developed image is fused to substrate 16 by passing substrate 16 between a fusing member 20 and a pressure member 21 to form a permanent image. Photoreceptor 10, after transfer, advances to cleaning station 17, wherein any remaining toner is cleaned therefrom, for example by use of a cleaning blade 22, brush, or other cleaning apparatus. Although the apparatus architecture is shown in FIG. I with reference to a photoreceptor drum, the same architecture is used, with suitable modifications, with a flexible imaging member belt as well.

Figure 2:
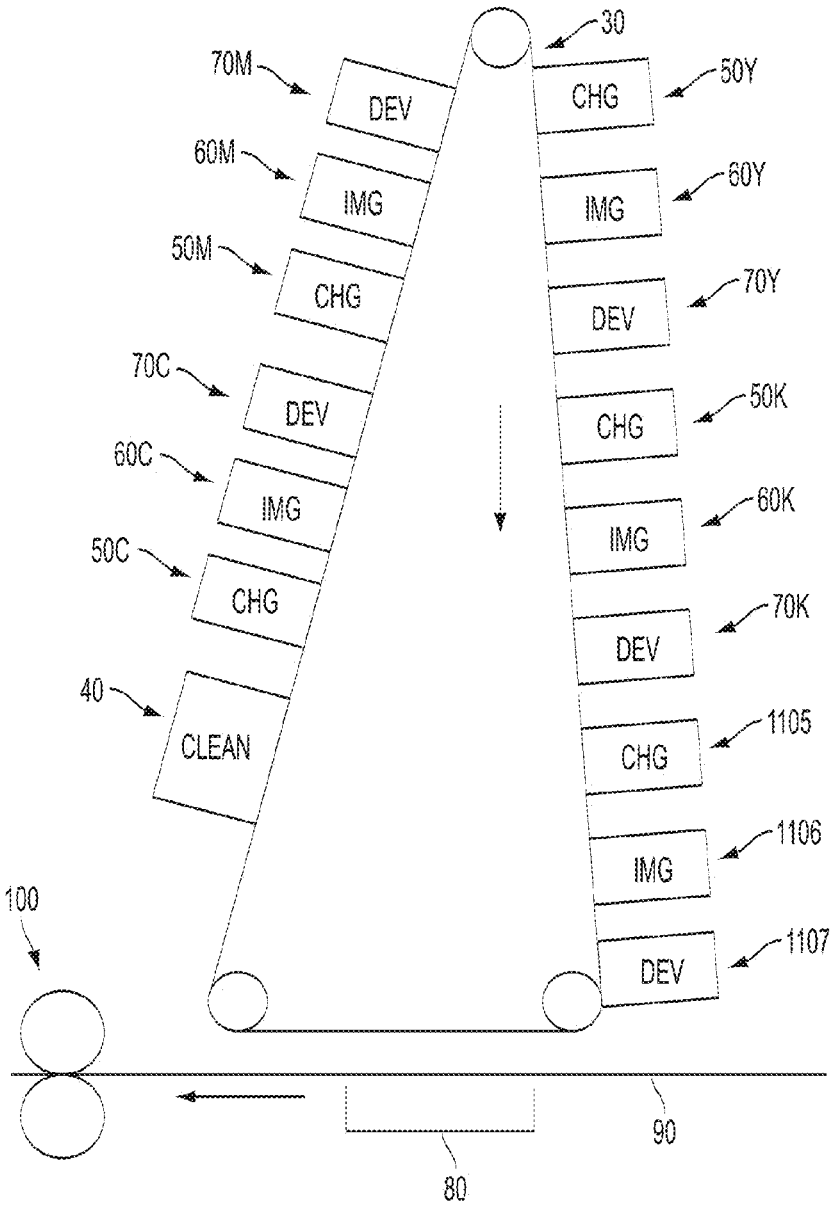
FIG. 2 is a first illustration of a color printing process of the present disclosure.

FIG. 2 illustrates the xerographic process for color images with a flexible imaging member belt. The process is depicted here using the four colors of the CMYK in an image-on-image (IOI) process where the composite color image is first assembled on the imaging member. In process steps not illustrated here, a light image of an original to be copied is taken and processed into four different electrostatic latent images, one for each color. Each electrostatic latent image will differ slightly from each other.

Again, photoreceptor belt 30 moves clockwise. First, at cleaning station 40, any residual toner is removed from the belt 30. The belt 30 then moves into the cyan development area. Here, charging unit 50C applies a substantially uniform electrostatic charge to the belt 30. Imaging unit 60C then writes the latent electrostatic image for cyan onto the uniformly electrostatically charged portion of belt 30. Developing unit 70C then applies cyan toner to the cyan latent electrostatic image.

The belt 30 then moves into the magenta development area. At charging unit 50M, the belt 30 again receives a substantially uniform electrostatic charge, effectively removing the cyan latent image, albeit with the cyan toner image already applied to belt 30. At imaging unit 60M, the latent electrostatic image for magenta is written onto the uniformly electrostatically charged portion of belt 30. Developing unit 70M then applies magenta toner to the magenta latent electrostatic image.

The process is repeated for yellow and black as well. Of course, the order in which the colors are added is not important. The result is a fully developed image made up of toner particles of all four colors. The belt 30 then moves to transfer station 80, which receives a substrate 90 and transfers the fully developed image from belt 30 to substrate 90. Again, the substrate is moving from right to left. The substrate then moves to fusing station 100 to form a permanent image.

As discussed above and with reference to a black/white image, in halftoning, colored toner particles are placed in the form of dots in some pixels and not in other pixels. This results in a gray scale. During transfer of the deposited toner particles from an imaging member to a receiving substrate, the toner particles in the dots spread (i.e. the dot gain increases). One reason for dot gain is that the toner particles in a dot all have the same charge and as a result, repel each other. The toner particles in the core of the dot are relatively insensitive to this disturbance due to the balance of forces (i.e. they are repelled on all sides equally and as a result, do not move). However, the forces on the toner particles on the edge of the dot are not balanced and toner particles on the edge are thus susceptible to this disturbance. This results in loss of sharpness and increased image noise.

In the processes of the instant disclosure, this spread of toner particles from the edge of the dot is reduced or prevented. Generally speaking, the fully developed image is stabilized by placing stabilizing toner particles on the fully developed image to form a stabilized image. The stabilizing toner particles will be a different color from the colored toner particles and are generally clear. They may also be the same color as the receiving substrate (e.g. white, to match white paper) or simply have a lower concentration of colorant compared to regular color toners, such as light cyan, light magenta or grey (light black) toners. Without being bound by theory, the presence of the stabilizing toner particles prevents the colored toner particles from spreading out. Because the colored toner particles thus remain where they were placed and because the stabilizing toner particles are generally invisible to the eye, the halftone images appear sharp, with little or no reduction in image quality.

Figure 3:
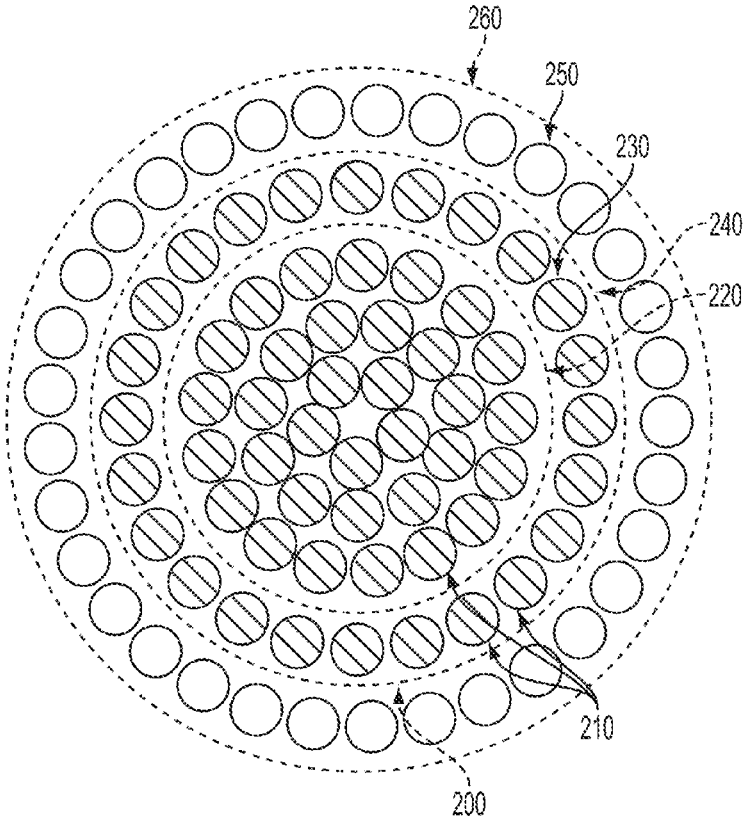
FIG. 3 depicts a toner dot illustrating a first embodiment of a printing process of the present disclosure.

FIG. 3 illustrates a first embodiment of such a process. Toner dot 200 is formed from multiple colored toner particles 210. The dot 200 may be considered as having a core, denoted by dotted line 220, and an edge 230, denoted by the annular area between dotted lines 220 and 240. The toner particles in the edge 230 are prevented from spreading by placing stabilizing toner particles 250, having a stabilizing color, around the edge 230 of the dot 200. The stabilizing toner particles 250 are a different color from the colored toner particles 210. As a result of the placement of the stabilizing toner particles, the toner particles in the edge 230 are more stable and do not spread out. Conceptually, one may think of the combination as creating a new dot having a new core containing colored toner particles denoted by dotted line 240 and a new edge containing stabilizing toner particles denoted by the annular area between dotted lines 240 and 260. Although the stabilizing toner particles 250 will spread out, they are not visible or easily seen, so the visible dot formed from the colored toner particles will remain sharp. As a result, lines formed from the dots will appear to have sharper edges.

Figure 4:
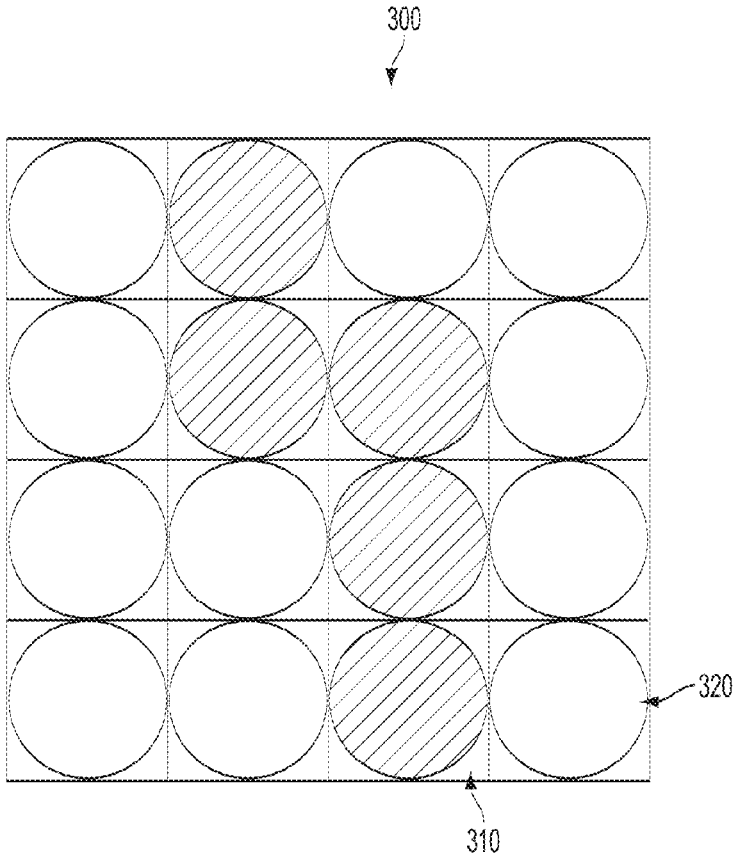
FIG. 4 depicts a halftone cell illustrating a second embodiment of a printing process of the present disclosure.

FIG. 4 illustrates a second embodiment of such a process. A halftone cell 300 is made up of an array of pixels; as depicted here, the cell 300 is a 4×4 array of pixels, though cells are generally much larger (e.g., 16×16). Five of the pixels contain dots 310 made from colored toner particles. The remaining 11 pixels would normally remain empty. However, in the instant processes, those 11 pixels are now filled with dots 320 made from stabilizing toner particles. Their presence prevents the colored dots 310 from having a space to spread out into. As a result, the colored dots 310 remain sharp. This may be considered an active placement of stabilizing toner particles to form a stabilized image.

Put another way, the 16 pixels of the cell 300 define a group of pixels. The five pixels containing colored dots 310 may be considered a first set of pixels and the remaining 11 pixels (which do not contain colored dots 310) may be considered a second set of pixels. The first and second sets of pixels do not overlap (i.e. have no common members). A latent electrostatic image is developed by placing colored toner particles in the first set of pixels, and the resulting developed image is stabilized by placing stabilizing toner particles in the second set of pixels.

More broadly, the latent electrostatic image may be considered as defining a group of pixels (i.e., all pixels on the latent electrostatic image are in the group). The group of pixels in the latent electrostatic image comprises a primary set of pixels and a secondary set of pixels. The primary and secondary sets of pixels do not overlap. The primary set of pixels may contain those pixels which receive colored toner particles. Stabilizing toner particles may be placed in the secondary set of pixels, depending on the embodiment of the instant processes that is used. If desired, the group of pixels further comprises a tertiary set of pixels, wherein the primary secondary, and tertiary sets of pixels do not overlap. No toner particles are placed in the pixels in the tertiary set.

FIG. 4 should not be construed as completely describing all halftone printing situations or processes. For example, the dots formed from the toner particles are usually larger than the pixel they are intended to be placed in. The instant processes apply to other halftone printing processes where the stabilizing toner particles operate to keep the colored toner particles together. As another example, the toner particles may be printed in the shape of dots, ovals, ellipses, squares, triangles, donuts, diamonds, pinwheels, etc., and the processes of the present disclosure will still be applicable.

Generally, the electrostatic latent image(s) and residual electrostatic image(s) can be developed through many conventional electrostatic development systems, contact or non-contact, such as magnetic brush, AC jumping, hybrid scavengeless development (HSD), etc. However, the placement of the stabilizing toner particles needs to be very accurate and extremely gentle such that the stabilizing toner particles are placed next to the colored toner particles without disturbing them.

One type of development system, known as scavengeless development, is particularly suitable for developing the electrostatic images. It is used in electrostatic printers that implement an 101 (image on image) architecture as illustrated in FIG. 2, where color images are assembled on the imaging member. Scavengeless development is a very "gentle" system. Toner particles are not physically brought into contact with the imaging member that carries the electrostatic latent image. Instead, the toner particles are presented in the vicinity of the imaging member surface, for example in the form of a toner cloud. The toner particles are guided by the electrostatic fields formed from the electrostatic latent image and migrate towards the desired image areas. As a result, scavengeless development systems are able to develop subsequent colors without "scavenging" the toners that were previously deposited onto the imaging member. Any discussion of depositing or contacting toner particles onto the imaging member herein should not be construed as requiring physical contact, as no such physical contact occurs in these scavengeless development methods.

In some embodiments, there are no intervening steps between developing the image (by placing colored toner particles) and stabilizing the image (by placing stabilizing toner particles). In other words, there is generally no charging, imaging, erasing, or transferring step between the placement of the toner particles onto the photoimaging members. In particular, the colored toner particles and the stabilizing toner particles are placed on the imaging member prior to transferring the image, whether to a receiving substrate (such as paper) or an intermediate transfer member. Put another way, the developing step and stabilizing step are performed consecutively.

In these embodiments, the electrostatic latent image, which determines where the colored toner particles are placed, also helps determine where the stabilizing toner particles are placed. Without being bound by theory, although the electrostatic latent image is developed by placement of colored toner particles, the electrostatic latent image is not completely wiped out. In other words, the electrostatic charge is only partially neutralized by the colored toner particles, so that a residual electrostatic image remains. The residual electrostatic image can be used to position the stabilizing toner particles at the edges of the dots formed by the colored toner particles. This may be considered a passive placement of stabilizing toner particles around the edges of the dots.

Figure 5A:
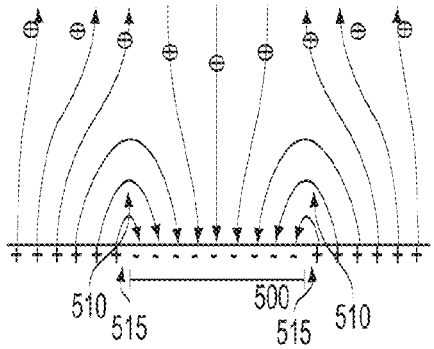
FIG. 5 illustrates the deposition of toner particles based on the electrostatic latent image.
Figure 5B:
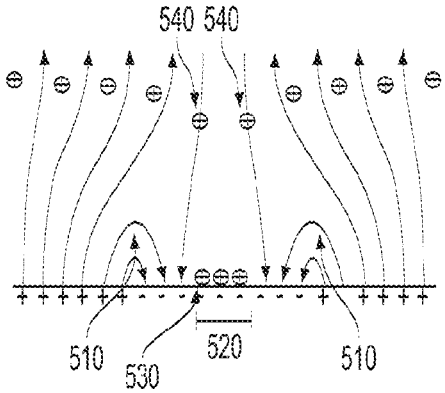
Figure 5C:
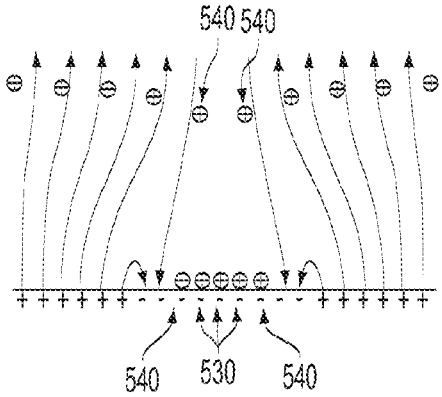

Without being bound by theory, it is believed that this positioning may be due to two effects. The first effect is illustrated in FIG. 5. FIG. 5A depicts the electrostatic fields generated by a fine feature, such as a dot 500, in the electrostatic latent image. Fringe lines exist at the edges 515 of the dot, i.e. the boundaries between areas with high and low voltages. Fringe fields 510 exist along the fringe lines; they originate from the high voltage side of the fringe line (shown with a + sign) and end on the low voltage side (shown with a − sign). These fringe fields are typically very strong (due to the large voltage drop across a short distance) and are spatially localized. In FIG. 5A, the strength of the fringe field 510 is illustrated by three curved lines. The residual electrostatic image may be considered a high voltage area, while the colored dot is considered a low voltage area. Initially, due to the fringe fields, the colored toner particles 530 are only deposited (i.e. developed) on areas far away from the edges 515, i.e. near the center 520 of the dot 500; see FIG. 5B. These deposited toner particles 530 will partially neutralize the latent image and change the electrostatic fields. This change in electrostatic field strength is illustrated in FIG. 5B by the fringe field 510 having only two curved lines. As a consequence, as shown in FIG. 5C, subsequent stabilizing toner particles 540 are deposited into regions closer to the edge 515 which were initially "protected" by the stronger fringe field 510 of FIG. 5A. In general, toner particle deposition begins far from the edges and then progresses towards the edges. Thus, in the instant processes, colored toner particles are deposited first and the stabilizing toner particles, which are deposited later, are deposited preferentially around the edges. Second, the colored toner particles and the stabilizing toner particles have the same polarity. As a result, it is believed that the colored toner particles, which are already placed in dots, repel the stabilizing toner particles placed upon them, and essentially move the stabilizing toner particles to the edges of the colored dots. There is thus a high probability that the stabilizing toner particles will land around the edges of the colored dots making up the halftone image.

The processes of the present disclosure are also applicable to color halftone images. The process is essentially the same. A fully developed image is formed by placing toner particles of at least three different colors on an imaging member. The fully developed image is then stabilized by placing stabilizing toner particles on the developed image to form a stabilized image, which is then transferred to a receiving substrate.

Figure 6:
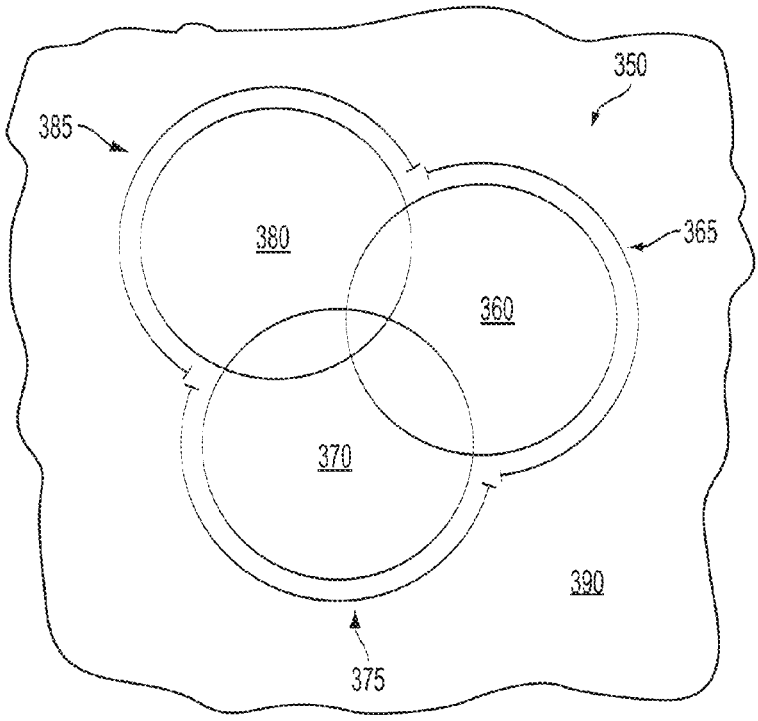
FIG. 6 depicts a rosette made from toner dots of three different colors and illustrates the application of a printing process of the present disclosure.

The same principles apply as to the placement of the stabilizing toner particles around a color image. FIG. 6 depicts a rosette 350 formed by the intersection of three colored dots: cyan dot 360, magenta dot 370, and yellow dot 380. The three colored dots are printed on background 390 and overlap to some extent. However, each dot has a non-overlapping edge 365, 375, 385. As shown here, the latent image on the photoconductor is erased after the last color, yellow dot 380, is laid down. Due to the pile height and the charges carried by the toner particles in dot regions 360, 370, and 380, a weak latent image is formed with voltage contrast between the background area 390 and the image areas 360, 370, and 380. This latent image can be used to place stabilizing toner particles into edges 365, 375, 385 and, optionally, background area 390. Because of the weak contrast, stabilizing toner particles may be deposited upon image areas 360, 370, and 380. This should not seriously affect the developed image since the stabilizing toner particles will generally be either clear or light-colored, such that they cannot be seen and will not affect the color of the areas covered by cyan dot 360, magenta dot 370 or yellow dot 380. This process results in stabilizing toner particles being located in an area around the colored toner particles.

Figure 7:
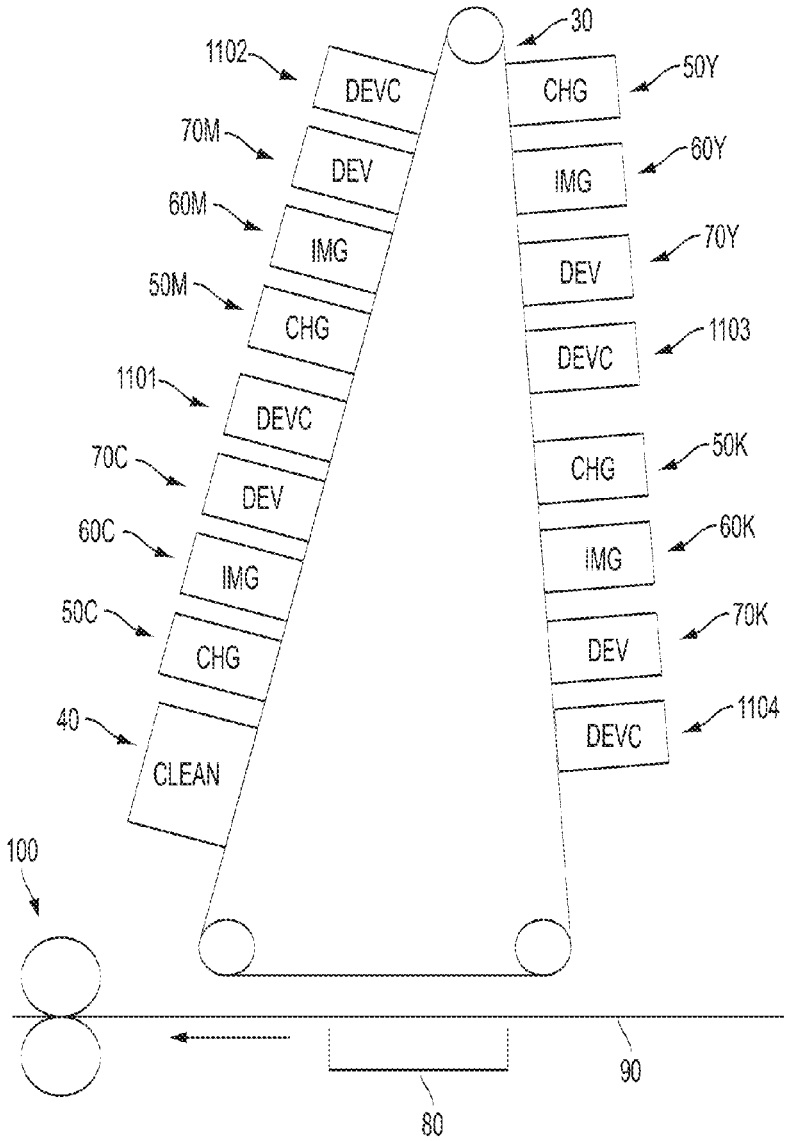
FIG. 7 is a second illustration of a color printing process of the present disclosure.

The stabilizing toner particles may be laid down in at least two ways. First, the development of each color may be followed by a development using the stabilizing toner particles. For example, as seen in FIG. 7, after the cyan is developed at 70C, the stabilizing toner particles are developed using the residual electrostatic image at 1101. The combination of the deposition of cyan and stabilizing toner particles may be considered a stabilized partial image. Similarly, stabilizing toner particles are developed using the residual electrostatic images for each of the other three colors at 1102, 1103, and 1104 to form additional stabilized partial images. In these embodiments, each electrostatic latent image may be considered as defining a group of pixels, the group of pixels divided into at least a primary set of pixels and a secondary set of pixels. The colored toner particles are placed in the primary set of pixels, and the stabilizing toner particles are placed in the secondary set of pixels. In certain embodiments, there are a total of two sets of pixels in the group of pixels, so that all pixels are in either the primary set or the secondary set. In other embodiments, there are a total of three sets of pixels. In these latter embodiments, the tertiary set may contain pixels in which neither colored toner particles nor stabilizing toner particles are placed. These embodiments having three sets of pixels in the group may be appropriate for certain images and may aid in reducing the use of stabilizing color particles. For example, the electrostatic latent image may be a circle. The primary set of pixels would have black toner particles in them, the secondary set of pixels would be those pixels near the perimeter of the primary set of pixels and have stabilizing toner particles placed in them, and the tertiary set of pixels would be those pixels located far from the primary set of pixels, such as those pixels in the center of the circle, and would have no stabilizing toner particles placed in them.

In FIG. 7, the stabilized partial images are assembled on the photoconductor and transferred to substrate 90 in a single step. Alternatively, the stabilized partial imagescan be applied to the receiving substrate separately i.e. one color at a time.

In other embodiments, a developed image may first be formed from all the colors. This developed image is then stabilized as illustrated by FIG. 6, before being transferred to the receiving substrate. In other words, the stabilizing toner particles are only deposited once after all the colors are developed, not as each color is developed. As shown in FIG. 2, the stabilizing toner particles may be considered a fifth color and deposited in the same manner as the other four colors used here. A substantially uniform electrostatic charge would be applied at charging station 1105, a stabilizing electrostatic latent image would be laid down at imaging station 1106, and then development would occur at development station 1107. In these embodiments, the developing and stabilizing steps should not be considered as being consecutive because multiple charge and erase steps occur between the development (using colored toner particles) and stabilization (using stabilizing toner particles).

Again, an image may be fully developed by placement of toner particles of at least three different colors. The three colors may be considered as being placed in a first, second, and third set of pixels, one set for each color. The stabilizing toner particles may then be considered as being placed in a fourth set of selected pixels, where the fourth set of pixels has no common members with the first, second, or third set of pixels.

As is well known, color halftone images are printed at different screen angles to reduce moire patterns. It should be noted that the deposit of the stabilizing toner particles is based on the dots containing the colored toner particles, not based on the location of the pixels. Because the location of the set of pixels defined by each electrostatic latent image may overlap on the imaging member, it is possible for deposited color toner particles to overlap and form rosettes.

Clear toners have been previously used to protect the printed image. In such uses, the clear toner is applied over the entire developed image, not selectively as in the present disclosure. Clear toners have also been previously used to even the heights of toner stacks, so that the height of the developed image is consistent over the entire image and a more uniform gloss is obtained. In both cases, the clear toner is also usually applied after the colored toner particles have already been transferred to a substrate, such as paper. In contrast, the clear toner must be applied here prior to transfer to obtain reduced image noise. In addition, the clear toner in these prior applications is generally required to be the uppermost layer on the paper (i.e., the toner furthest away from the paper, such that the colored toner particles are between the clear toner and the paper). If such images were to be printed in a single transfer as illustrated in FIG. 2, the clear toner particles would have to be applied to the imaging member prior to any of the colored toner particles. In contrast, the stabilizing toner particles (i.e. clear toner) are applied after the colored toner particles in the instant processes. As a result, the reduced image noise of the instant processes cannot be obtained in the prior applications.

The following example illustrates the methods of the present disclosure. The example is merely illustrative and is not intended to limit the present disclosure with regard to the steps, materials, conditions, or process parameters set forth therein. All parts are percentages by weight unless otherwise indicated.

EXAMPLE

Figure 8:
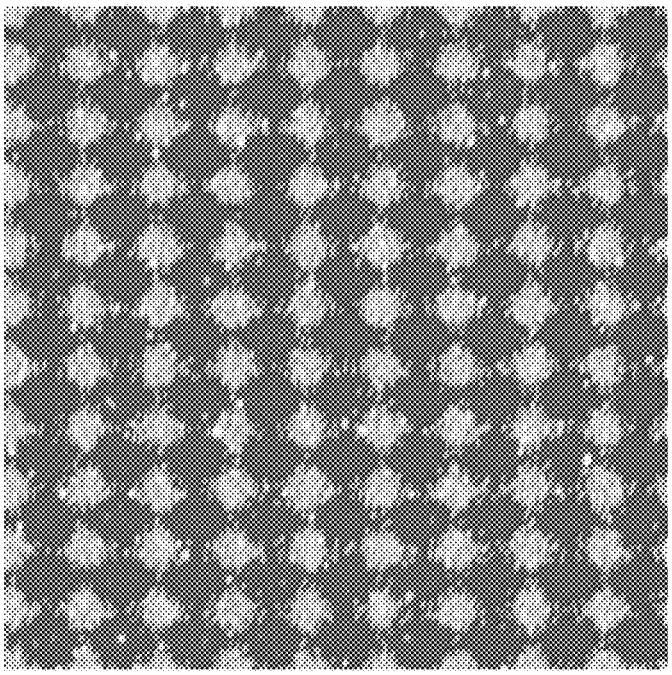
FIG. 8 is a "before" color image of a first example of the processes of the present disclosure prior to transfer.
Figure 9:
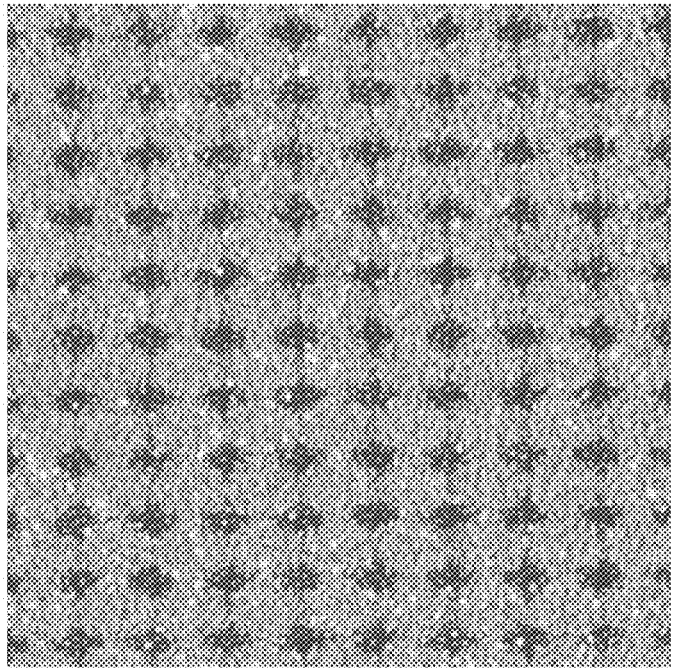
FIG. 9 is a "before" color image of a second example of the processes of the present disclosure prior to transfer.
Figure 10:
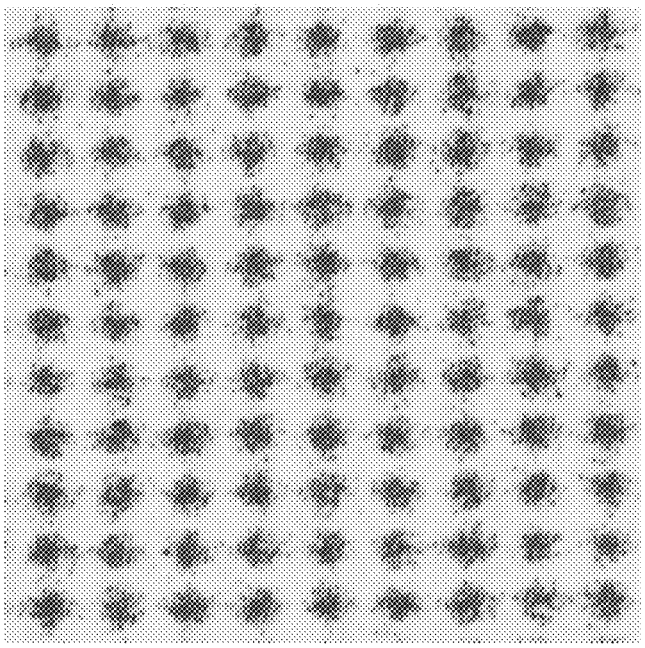
FIG. 10 is an "after" color image of a first example of the processes of the present disclosure after transfer.
Figure 11:
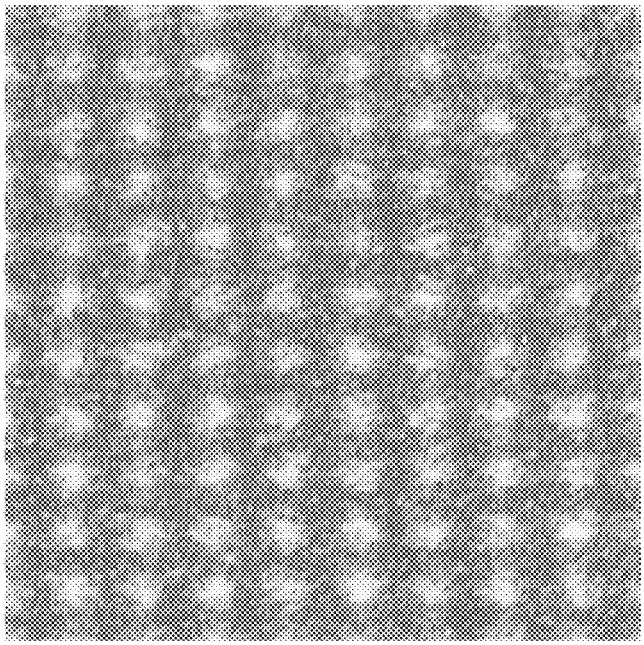
FIG. 11 is an "after" color image of a second example of the processes of the present disclosure after transfer.

An experiment was carried out by using magenta and cyan toner, where the cyan toner was used as the stabilizing (clear) toner. Magenta was developed first as the color toner and cyan was subsequently developed. FIGS. 8 and 9 are images showing the toner particles placed on an imaging member prior to transfer. They differ in the size of the magenta dot. FIGS. 10 and 11 are images showing the toner particles after transfer and without fusing. Spreading of the toner is visible. However, the scattered toner particles are predominantly cyan (i.e. the clear stabilizing toner), while the core of the magenta dots are mostly undisturbed.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. A method of printing halftone images, comprising:

providing an imaging member;

producing an electrostatic latent image for a first color on the imaging member, the electrostatic latent image for the first color defining a first group of pixels;

developing the electrostatic latent image for the first color on the imaging member by depositing colored toner particles of the first color into a first set of pixels on the electrostatic latent image for the first color to form a dot in each pixel, each dot having a core and an edge, to form a first developed image;

stabilizing the first developed image on the imaging member by locating stabilizing toner particles of a stabilizing color around the edge of each dot in the first set of pixels on the electrostatic latent image for the first color to form a stabilized image, wherein the stabilizing toner particles are not present in the core or edge of each dot;

producing an electrostatic latent image for a second color on the imaging member, the electrostatic latent image for the second color defining a second group of pixels;

developing the electrostatic latent image for the second color on the imaging member by depositing colored toner particles of the second color into a second set of pixels on the electrostatic latent image for the second color to form a dot in each pixel, each dot having a core and an edge, to form a second developed image;

stabilizing the second developed image on the imaging member by locating stabilizing toner particles of the stabilizing color around the edge of each dot in the second set of pixels on the electrostatic latent image for the second color to form a stabilized image, wherein the stabilizing toner particles are not present in the core or edge of each dot; and transferring the stabilized image to a receiving substrate.

2. The method of claim 1, wherein the stabilizing toner particles are clear or have a colorant concentration substantially lower than the colored toner particles of the first color.

3. The method of claim 1, wherein the stabilizing color is the same color as the color of the receiving substrate.

4. A method of printing halftone images, comprising:

providing an imaging member;

producing an electrostatic latent image for a first color on the imaging member, the electrostatic latent image for the first color defining a first group of pixels, the first group of pixels containing a first set of pixels and a second set of pixels, wherein the first set of pixels and second set of pixels do not overlap;

developing the electrostatic latent image for the first color on the imaging member by depositing colored toner particles of the first color into the first set of pixels of the first group of pixels to form a dot in each pixel, each dot having a core and an edge, to form a first developed image;

stabilizing the first developed image on the imaging member by placing stabilizing toner particles of a stabilizing color in the form of dots into the second set of pixels of the first group of pixels;

producing an electrostatic latent image for a second color on the imaging member, the electrostatic latent image for the second color defining a second group of pixels, the second group of pixels containing a first set of pixels and a second set of pixels, wherein the first set of pixels and second set of pixels do not overlap;

developing the electrostatic latent image for the second color on the imaging member by depositing colored toner particles of the second color into the first set of pixels of the second group of pixels to form a dot in each pixel, each dot having a core and an edge, to form a second developed image;

stabilizing the second developed image on the imaging member by placing stabilizing toner particles of the stabilizing color in the form of dots into the second set of pixels of the second group of pixels; and transferring the stabilized image to a receiving substrate;

wherein stabilizing toner particles are not placed in the first set of pixels of the first group of pixels or in the first set of pixels of the second group of pixels.

5. The method of claim 4, wherein the group of pixels is divided into only the first set of pixels and the second set of pixels.

6. The method of claim 4, wherein the group of pixels is divided into the first set of pixels, the second set of pixels, and a third set of pixels, wherein the first set of pixels, second set of pixels, and third set of pixels do not overlap.

7. The method of claim 4, wherein the stabilizing toner particles are clear or have a colorant concentration substantially lower than the colored toner particles of the first color.

8. The method of claim 4, wherein the stabilizing color is the same color as the color of the receiving substrate.

* * * * *